US006871641B1

(12) United States Patent
Chen

(10) Patent No.: US 6,871,641 B1
(45) Date of Patent: Mar. 29, 2005

(54) AIR-ACTIVATING DEVICE

(76) Inventor: Tung-Sen Chen, No. 7-3, Alley 7, Lane 128, Sec. 3, Shiow-Lang Rd., Jong-Her City, Taipei Hsien (TW)

( * ) Notice: Subject to any disclaimer, the term of this patent is extended or adjusted under 35 U.S.C. 154(b) by 0 days.

(21) Appl. No.: 10/766,813

(22) Filed: Jan. 30, 2004

(51) Int. Cl.[7] ..... F02M 33/00
(52) U.S. Cl. ..... 123/539
(58) Field of Search ..... 123/536–539

(56) References Cited

U.S. PATENT DOCUMENTS 4,461,262 A * 7/1984 Chow ..... 123/536
5,010,869 A * 4/1991 Lee ..... 123/539
6,244,254 B1 * 6/2001 Chen ..... 123/536

* cited by examiner

*Primary Examiner*—Marguerite McMahon
(74) *Attorney, Agent, or Firm*—Troxell Law Office PLLC

(57) ABSTRACT

The invention relates to an air-activating device made of material with magnetism or far infrared radiation. The air-activating device has a plurality of vent holes that are extended parallel to each other and whose internal diameter becomes smaller from inlet toward outlet. The vent holes are closely disposed for reducing the clearance between every two inlets, thereby thinning the windward parts. Moreover, the air-activating body is suitable to be placed in an air filter of internal combustion engine or fixed in an air inlet pipe thereof. Thanks to the tapering structure of the vent holes, the airflow through the vent holes can be squeezed to increase the pressure and the flow rate of incoming air. Due to the thinning of the windward parts, the windward resistance and the airflow disturbance are diminished. In addition, the magnetic lines of force or the far infrared radiation are utilized to activate the passing air for an effective increase of the engine performance and for a desired protection against air pollution.

20 Claims, 3 Drawing Sheets

AIR-ACTIVATING DEVICE

BACKGROUND OF THE INVENTION

1. Field of the Invention

The invention relates to an air-activating device, and more particularly, to a device having a plurality of closely disposed vent holes whose internal diameter becomes smaller from inlet toward outlet for squeezing air to increase the airflow rate. In addition, the magnetic lines of force or the far infrared radiation are utilized to activate more air for an effective increase of the engine performance.

2. Description of the Related Art

The present invention is an improvement of U.S. Pat. No. 6,244,254 B1. As illustrated in FIG. 1, the air-activating body 2 is made of material with magnetism or far infrared radiation. The air-activating body 2 includes a plurality of vent holes 21 with uniform internal diameter. In addition, the magnetic lines of force or the far infrared radiation are utilized to act on the passing air for a more complete mixing with the fuel thanks to an increased contact area of air with fuel. However, this configuration also has following drawbacks:

1. In order to achieve the air-activating effect by magnetic lines of force or far infrared radiation and to meet the requirement of their density, a certain clearance between every two vent holes 21 must be maintained. Therefore, a windward part 22 between every two vent holes 21 has to be formed in a large area, thereby causing a great wind resistance to the incoming airflow. Meanwhile, this will produce the airflow disturbance and influence the air-incoming smoothness.

2. Since the thickness of the windward parts 22 is uniform, no accelerating or pressurizing effect acting on the airflow can be created. Thus, the wand of the windward parts 22 will produce resistance to the passing airflow, thereby reducing the air-incoming speed.

SUMMARY OF THE INVENTION

In light of the demerits of the prior art, the invention provides an air-activating device that aims to ameliorate at least some of the disadvantages of the prior art or to provide a useful alternative.

A primary objective of the invention is to provide an air-activating device made of material with magnetism or far infrared radiation. The air-activating device has a plurality of vent holes that are extended parallel to each other and whose internal diameter becomes smaller from inlet toward outlet. The vent holes are closely disposed for reducing the clearance between every two inlets, thereby thinning the windward parts. Moreover, the air-activating body is suitable to be placed in an air filter of internal combustion engine or fixed in an air inlet pipe thereof. Thanks to the tapering structure of the vent holes, the airflow through the vent holes can be squeezed to increase the pressure and the flow rate of incoming air. Due to the thinning of the windward parts, the windward resistance and the airflow disturbance are diminished. In addition, the magnetic lines of force or the far infrared radiation are utilized to activate the passing air for an effective increase of the engine performance and for a desired protection against air pollution.

Another objective of the invention is to provide an air-activating device utilizing the vent holes whose internal diameter becomes smaller from inlet toward outlet. Even when the vent holes are closely disposed, the thickness between every two outlets of the vent holes can be maintained to avoid the insufficient density of magnetic lines of force or the far infrared radiation of the air-activating body 1 due to the too thin wand between the vent holes. Meanwhile, the clearance (thickness) between every two inlets can be reduced to a certain extent for minimizing the wind resistance of the windward parts, preventing the creation of airflow disturbance between every two inlets and eliminating the hindrance to the airflow.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
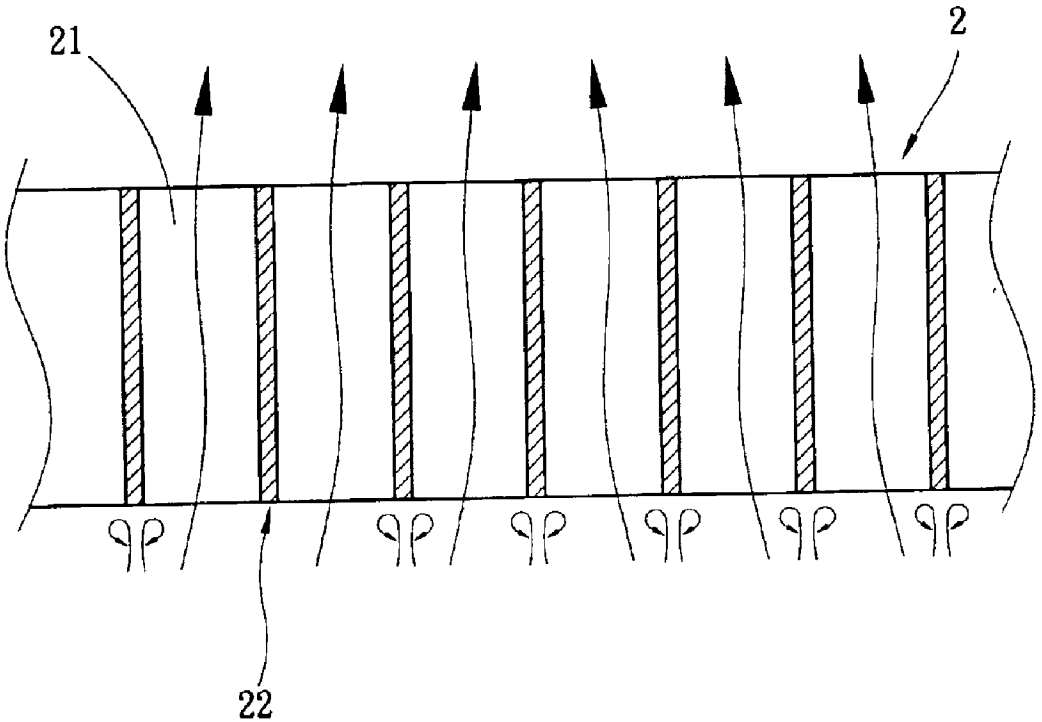
Fig. 1 (Prior Art)
FIG. 1 is a cutaway view of a conventional air-activating device.
Figure 2:
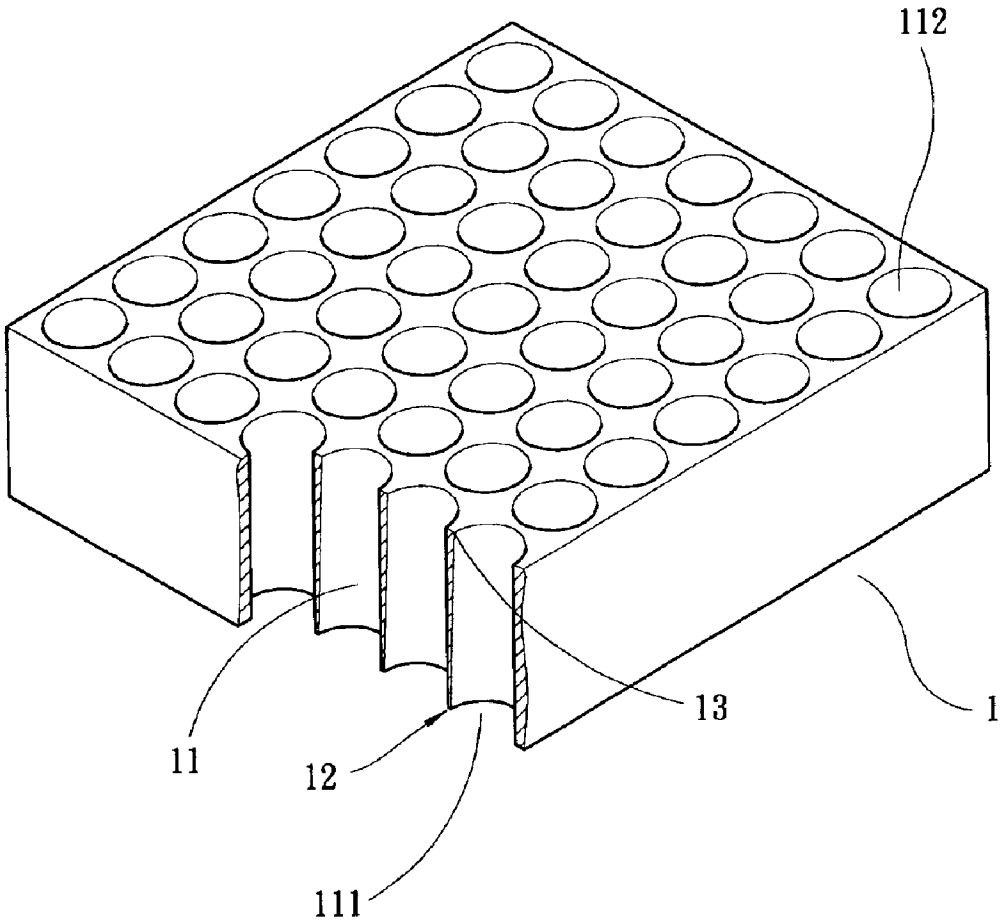
FIG. 2 is a perspective view of the air-activating device of the invention.
Figure 3:
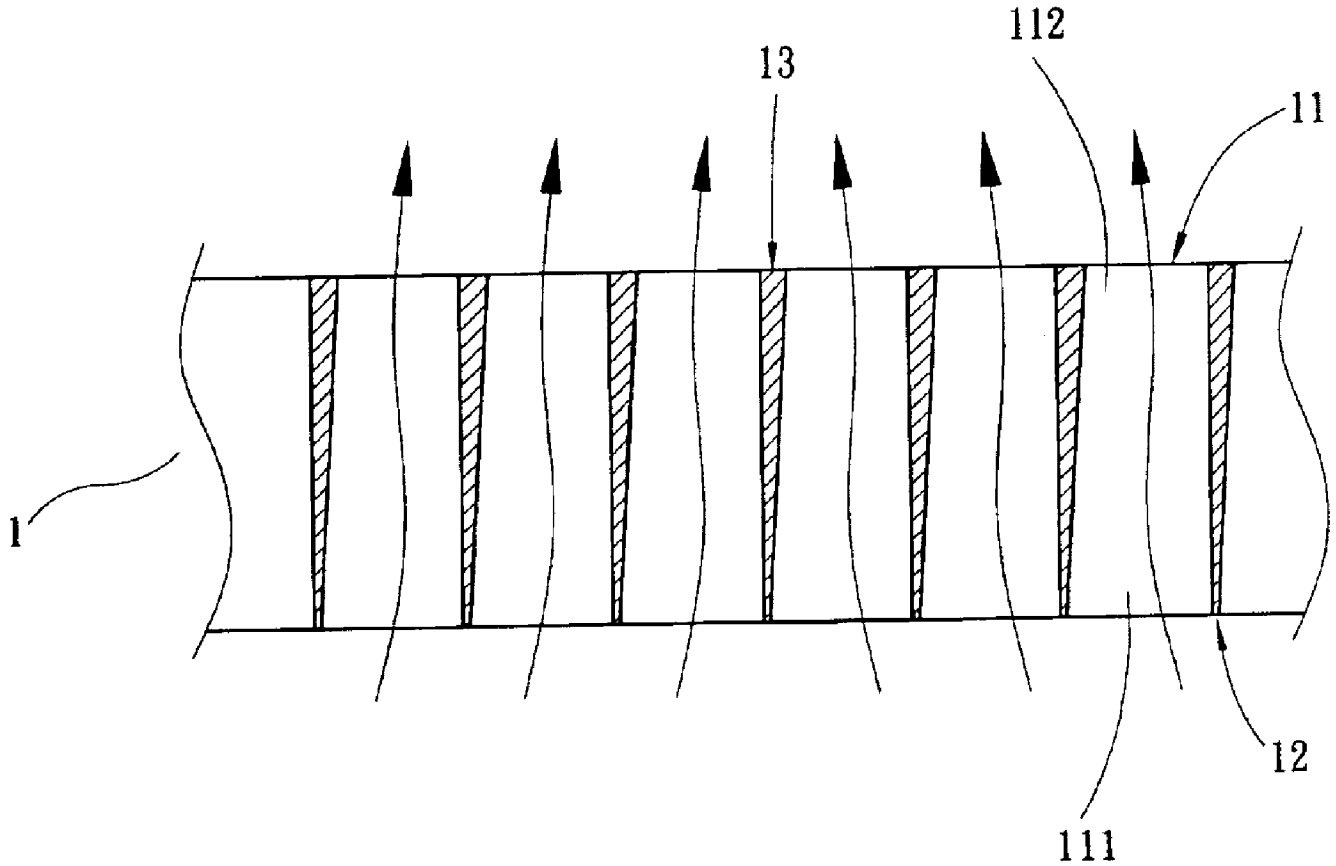
FIG. 3 is a cutaway view of the air-activating device of the invention.

First of all, referring to FIG. 3 the air-activating device in accordance with the invention is constructed as an air-activating body 1 made of material with magnetism or far infrared radiation and has a plurality of closely disposed vent holes 11 whose middle lines are parallel to each other and whose internal diameter becomes smaller from one end (inlet 111) toward the other end (outlet 112), thereby creating thinner windward parts 12 between every two adjacent inlets 111 und thicker leeward parts 13 between every two adjacent outlets 112. Moreover, the vent holes 11 are next to one another. In this way, the upper wand from the middle section of the vent holes 11 to its respective outlets 112 is thicker than the lower wand from the middle section of the vent holes 11 to its respective inlets 111. Therefore, the wand thickness from the middle part of the vent holes to the outlet 112 is enlarged to avoid the insufficient density of magnetic lines of force or the far infrared radiation of the air-activating body 1 due to the too thin wand between the vent holes 11.

For the actual application, the air-activating body 1 of the present invention can be placed in an air filter of internal combustion engine or fixed in an air inlet pipe thereof. Thanks to the tapering structure of the vent holes 11 whose internal diameter becomes smaller from the inlet 111 to the outlet 112, the airflow through the vent holes 11 can be squeezed to increase the pressure of incoming air and therefore to raise the speed of the airflow. Thus, the air-incoming efficiency is promoted. Due to the thinning of the windward parts 12 between every two inlets 111 of the vent holes 11, the windward resistance of the air-activating body 1 can be effectively diminished. Moreover, the airflow disturbance created near the windward parts 12 between every two inlets 111 can be minimized so that a smoother airflow can be achieved. By means that the magnetic lines of force of the air-activating body 1 cut through the fuel molecules, the fuel can be easily nebulized to promote the mixing ability with the dioxygen and to achieve a more complete combustion. Alternatively, the infrared radiation can nebulize the water molecule to increase the contact area with the fuel for a better combustion efficiency of engine.

It's to note that each of the vent holes 11 has a tapering internal diameter from the inlet 111 toward the outlet 112.

According to the experimental result, the diameter of the inlets 111 and the diameter of the outlet 112 are preferably in a ratio of 16.545 to 10 while the thickness of the windward parts 12 and the thickness of the leeward parts 13 are preferably in a ratio of 1:10. Meanwhile, it's preferable that the diameter of the inlets 111 amounts to 4.55 mm and the diameter of the outlets 112 amounts to 2.75 mm. Besides, it's preferable that the thickness of the windward parts 12 is 0.2 mm and the thickness of the leeward parts 13 amounts to 2 mm. The above-mentioned refers to the vent holes 11 having a circular cross section in radial direction. Certainly, the vent holes 11 can have a polygonal cross section in radial direction.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An air-activating device constructed as an air-activating body made of material with magnetism or far infrared radiation, the air-activating body having a plurality of vent holes whose internal diameter becomes smaller from one end (inlet) toward the other end (outlet), whereby the airflow in passing through the vent holes can be squeezed for increasing its flowing speed, and the air-activating body utilizes its magnetic lines of force or far infrared radiation to activate the passing air for an effective increase of the engine performance and for a desired protection against air pollution.

2. The air-activating device of claim 1 wherein the vent holes are closely disposed next to each other for reducing the clearance between every two adjacent inlets to form a thinner windward part, and wherein the clearance between every two adjacent outlets forms a thicker leeward part so that, thanks to the thinning of the windward parts, the windward resistance can be effectively minimized for protection against airflow disturbance.

3. The air-activating device of claim 1 wherein the diameter of the inlets and the diameter of the outlet are preferably in a ratio of 16.545 to 10.

4. The air-activating device of claim 2 wherein the diameter of the inlets and the diameter of the outlet are preferably in a ratio of 16.545 to 10.

5. The air-activating device of claim 3 wherein the diameter of the inlets preferably amounts to 4.55 mm and the diameter of the outlet preferably amounts to 2.75 mm.

6. The air-activating device of claim 4 wherein the diameter of the inlets preferably amounts to 4.55 mm and the diameter of the outlets preferably amounts to 2.75 mm.

7. The air-activating device of claim 1 wherein the thickness of the windward parts and the thickness of the leeward parts are preferably in a ratio of 1:10.

8. The air-activating device of claim 2 wherein the thickness of the windward parts and the thickness of the leeward parts are preferably in a ratio of 1:10.

9. The air-activating device of claim 3 wherein the thickness of the windward parts and the thickness of the leeward parts are preferably in a ratio of 1:10.

10. The air-activating device of claim 4 wherein the thickness of the windward parts and the thickness of the leeward parts are preferably in a ratio of 1:10.

11. The air-activating device of claim 7 wherein the thickness of the windward parts preferably amounts to 0.2 mm and the thickness of the leeward parts preferably amounts to 2 mm.

12. The air-activating device of claim 8 wherein the thickness of the windward parts preferably amounts to 0.2 mm and the thickness of the leeward parts preferably amounts to 2 mm.

13. The air-activating device of claim 9 wherein the thickness of the windward parts preferably amounts to 0.2 mm and the thickness of the leeward parts preferably amounts to 2 mm.

14. The air-activating device of claim 10 wherein the thickness of the windward parts preferably amounts to 0.2 mm and the thickness of the leeward parts preferably amounts to 2 mm.

15. The air-activating device of claim 1 wherein the vent holes have a circular cross section in radial direction.

16. The air-activating device of claim 2 wherein the vent holes have a circular cross section in radial direction.

17. The air-activating device of claim 3 wherein the vent holes have a circular cross section in radial direction.

18. The air-activating device of claim 1 wherein the vent holes have a polygonal cross section in radial direction.

19. The air-activating device of claim 2 wherein the vent holes have a polygonal cross section in radial direction.

20. The air-activating device of claim 3 wherein the vent holes have a polygonal cross section in radial direction.

* * * * *